US007321101B2

(12) United States Patent
Hirobe et al.

(10) Patent No.: US 7,321,101 B2
(45) Date of Patent: Jan. 22, 2008

(54) SWITCH DEVICE AND INPUT DEVICE USING THE SAME

(75) Inventors: Masahiro Hirobe, Shiga (JP); Takayoshi Kishimoto, Fukui (JP); Kenji Otomo, Fukui (JP); Hitokazu Shitanaka, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/552,220

(22) Filed: Oct. 24, 2006

(65) Prior Publication Data

US 2007/0089977 A1 Apr. 26, 2007

(30) Foreign Application Priority Data

Oct. 24, 2005 (JP) ..... 2005-308166
Sep. 21, 2006 (JP) ..... 2006-255592
Oct. 18, 2006 (JP) ..... 2006-283353

(51) Int. Cl.
*H01H 9/00* (2006.01)

(52) U.S. Cl. ..... 200/5 R; 200/5 A

(58) Field of Classification Search ..... 200/5 R, 200/5 A, 17 R, 18, 512, 517, 341–345, 329, 200/61.54; 341/22; 345/168, 169
See application file for complete search history.

(56) References Cited

U.S. PATENT DOCUMENTS

| | | | | |
|---|---|---|---|---|
| 5,121,091 | A * | 6/1992 | Fujiyama | 335/1 |
| 6,225,578 | B1 * | 5/2001 | Kobayashi et al. | 200/5 R |
| 6,433,773 | B1 * | 8/2002 | Hasuda | 345/156 |
| 6,800,819 | B2 * | 10/2004 | Sato et al. | 200/5 R |
| 7,002,089 | B2 * | 2/2006 | Stevenson | 200/512 |
| 7,019,225 | B2 * | 3/2006 | Matsumoto et al. | 200/5 R |
| 2001/0013463 | A1 * | 8/2001 | Asai et al. | 200/1 B |

FOREIGN PATENT DOCUMENTS

JP 2001-246994 9/2001

* cited by examiner

*Primary Examiner*—Michael A Friedhofer
(74) *Attorney, Agent, or Firm*—RatnerPrestia

(57) ABSTRACT

A switch device includes a operation body, a membrane switch pushed by the operation body, and plural push switches activated by pushing the operation body via the membrane switch. The membrane switch includes plural contact switches electrically connected upon being pushed by the operation body. The switch device is activated easily without operating errors.

30 Claims, 7 Drawing Sheets

SWITCH DEVICE AND INPUT DEVICE USING THE SAME

FIELD OF THE INVENTION

The present invention relates to a switch device to be used for controlling various electronic apparatuses, and to an input device using the switch device.

BACKGROUND OF THE INVENTION

Vehicles have recently had steering switches placed near their steering wheels. Operators often activate these switches with their fingers for controlling audio apparatuses or air-conditioners while the operators hold the steering wheels. The switches have been demanded to be used easily without operating errors.

FIG. 6 is a plan view of conventional input device 5001. Plural holes are provided in a top surface of case 1 made of insulating resin. Upper ends of operation bodies 2, 2A, and 2B made of insulating resin protrude movably from the holes.

Case 1 accommodates therein plural push-switches electrically connected and disconnected according to operation of operation bodies 2, 2A, and 2B, thus providing switch device 3. Pad 5 containing an airbag is placed at the center of steering wheel 4. Switch devices 3 are provided to both of spokes 6 placed at the vicinity of steering wheel 4 and between steering wheel 4 and pad 5.

The push switches of switch device 3 are coupled to a controller including electronic components, such as a microprocessor. An operator activates operation bodies 2A and 2B for electrically connecting and disclosing the push switches. In response to the electrical connection and disconnection of the switches, the controller controls electronic apparatuses, such as an audio apparatus or an air-conditioner installed in the vehicle.

While holding steering wheel 4, the operator extends a thumb of the operator to press operation body 2A of switch device 3 on the left side. Operation body 2A is marked with a symbol "↑" on its top. Upon being pressed, operation body 2A causes the push switch provided on a lower surface of unit 2A to be electrically connected and disconnected. In response to the connection and disconnection, the controller controls the electronic apparatus, for instance, to increase a sound volume of the audio apparatus.

Upon the operator pressing operation body 2B marked with a symbol "↓" on its top surface and situated below unit 2A, the push switch provided on a lower surface of unit 2B is electrically connected and disconnected, so that the controller decreases the sound volume of the audio apparatus.

Similar to above, upon being pressed, operation bodies 2C and 2D marked with a symbol "+" and a symbol "–" on their top causes push switches provided on respective lower surfaces of operation bodies 2C and 2D to electrically connected and disconnected, respectively. In response to this electrical connection and disconnection, for example, the controller raises and lowers set temperature of the air-conditioner for adjusting the temperature inside.

The operator can press operation bodies 2A to 2D by extending only, e.g. the thumb without having his/her hands released from holding steering wheel 4. The controller accordingly controls the electronic apparatuses in the vehicle, so that the operator can operate the electronic apparatuses easily while driving the vehicle.

With the conventional switch device 3 and input device 5001 employing switch device 3, the operator necessarily confirms which of operation body among operation bodies 2A to 2D corresponds to which electronic device by taking a glance at their top surfaces, hence operating the switch device not-so-easily with operating errors.

SUMMARY OF THE INVENTION

A switch device includes a operation body, a membrane switch pushed by the operation body, and plural push switches activated by pushing the operation body via the membrane switch. The membrane switch includes plural contact switches electrically connected upon being pushed by the operation body.

The switch device is activated easily without operating errors.

DESCRIPTION OF PREFERRED EMBODIMENT

Figure 1:
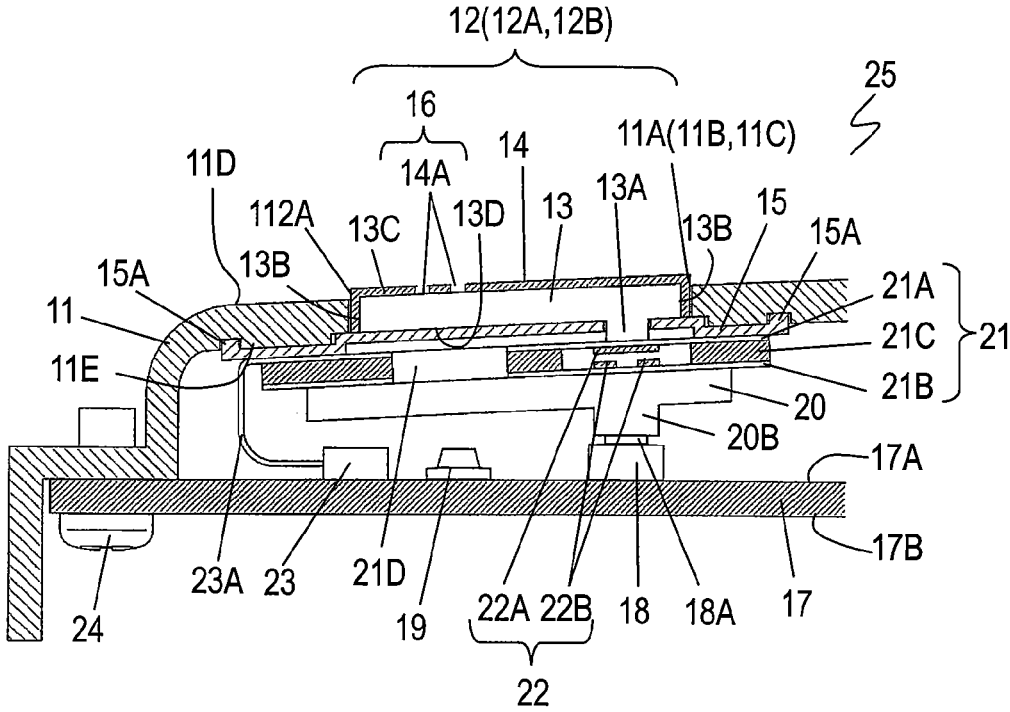
FIG. 1 is a sectional view of a switch device in accordance with an exemplary embodiment of the present invention.
Figure 2:
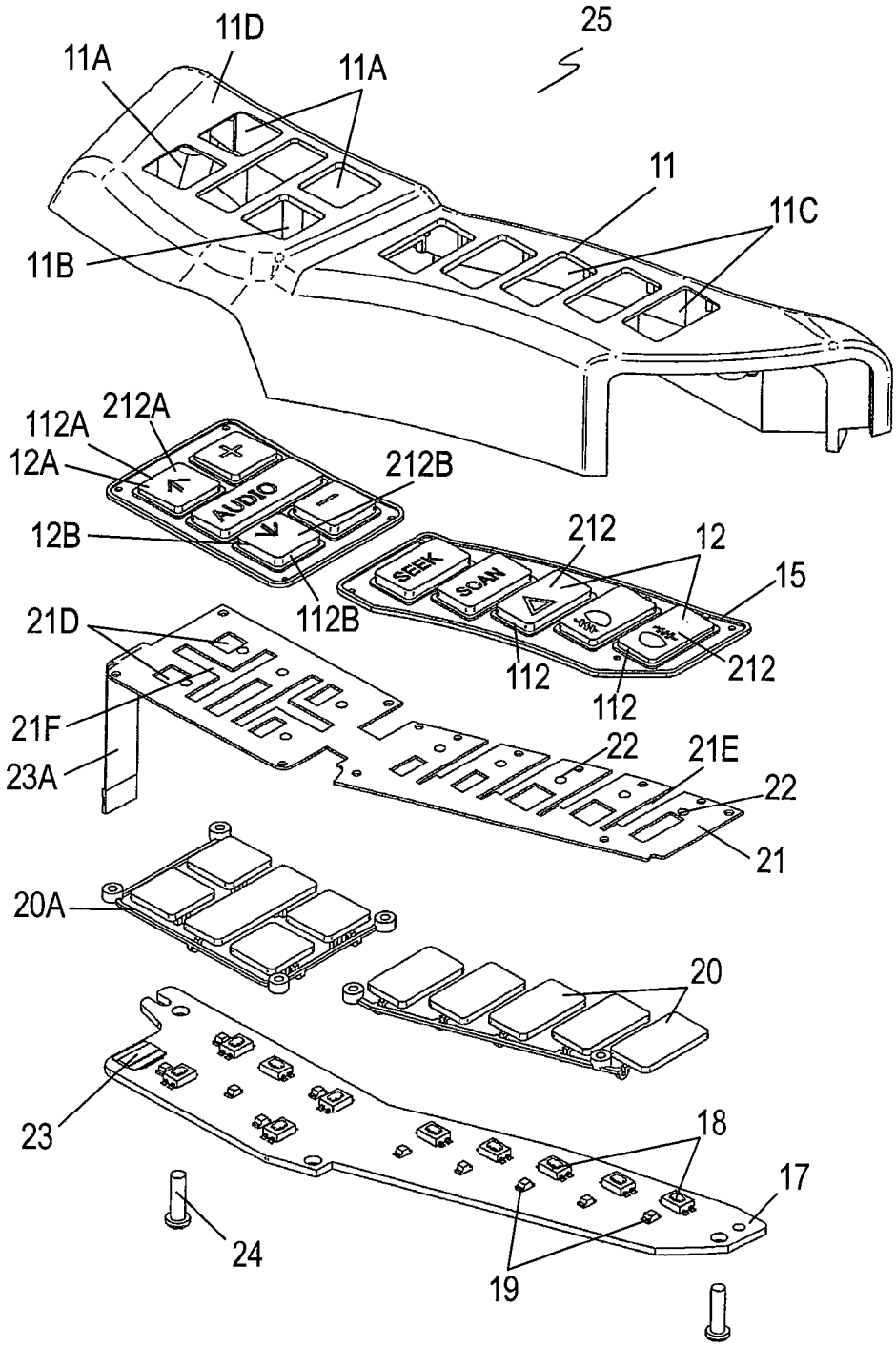
FIG. 2 is a perspective exploded view of the switch device in accordance with the embodiment.

FIGS. 1 and 2 are a sectional view and a perspective exploded view of switch device 25 in accordance with an exemplary embodiment of the present invention. Case 11 having substantially a box shape is made of insulating resin, such as ABS or polyacetal. Operation bodies 12, 12A, and 12B are made of insulating resin, such as polycarbonate, acrylic, or ABS. Holes 11A, 11B and 11C are formed in top surface 11D of case 11. Upper ends 112, 112A and 112B of operation bodies 12, 12A and 12B protrude movably from holes 11A, 11B vertically.

Each of operation bodies 12, 12A and 12B includes light-transmissible section 13 colored in light, such as white or milky-white, to be light-transmissible, and light-intransmissible section 14 colored in dark, such as black. Light-intransmissible section 14 covers top surface 13C and side surfaces 13B of light-transmissible section 13. Top surfaces 212, 212A and 212B of operation bodies 12, 12A and 12B have display areas 16 marked with a symbol, such as a symbol "↑", a symbol "↓", a symbol "+", and a symbol "–". Opening 14A is formed In display areas 16 of light-intransmissible section 14, and allows light-transmissible section 13 to exposed therefrom.

Operation bodies 12, 12A and 12B are linked together with base section 15 made of light-transmissible resin, such as silicone rubber or elastomer. Outer periphery 15A of base section 15 tightly adheres onto lower surface 11E of case 11, thereby preventing dust and water from entering into case 11 through a gap between operation body 12A and opening 11A.

A method of manufacturing operation bodies 12, 12A and 12B will be described below. Light-intransmissible paint is applied onto top surface 13C and side surfaces 13B of light-transmissible section 13 formed by molding, thus providing light-intransmissible section 14. Then, opening 14A is formed in light-intransmissible section 14 with laser beam, thus providing display area 16. Operation bodies 12, 12A and 12B may be formed by stacking sheets of insulating resin having different colors and shaping the stacked sheets.

Circuit board 17 made of insulating resin has top surface 17A and lower surface 17B. Plural circuit patterns are formed on both surfaces 17A and 17B. Push switch 18 is mounted on top surface 17A just below operation body 12. Push switch includes push button 18A protruding toward the operation body. Light emitting element 19, such as a light-emitting diode (LED), is mounted on top surface 17A just below operation body 12.

Pushing unit 20 is made of insulating resin, such as polycarbonate or acrylic, and is transparent or light-transmissible. Pushing unit 20 is placed under operation body 12. Bridge bar 20A having an arm shape couples plural pushing units 20 to each other. Pushing section 20B of pushing unit 20 protrudes downward to contact push button 18A of push switch 18.

Membrane switch 21 is placed between operation body 12 and pushing unit 20. Membrane switch 21 includes sheets 21A and 21B and spacer 21C. Sheets 21A and 21B are made of flexible resin, such as polyimide or polyethylene-terephthalate, having an insulating property. Spacer 21C is provided between sheets 21A and 21B and attached onto sheets 21A and 21B. Contact 22A on sheet 21A faces contact 22B on sheet 21B by a predetermined gap between the contacts. Contacts 22A and 22B are made of conductive material, such as carbon or silver. Light-transmissible section 13 of operation body 12 has projection 13A on lower surface 13D. Contact 22A is placed under projection 13A. Contacts 22A and 22B provides contact switch 22 which is electrically connected upon sheet 21A sagging.

Sheets 21A and 21B have slits 21E and holes 21F therein between contact switches 22 adjacent to each other. When certain contact switch 22 is activated, sheet 21A sags reliably without being affected by other portions including adjacent contact switch 22, accordingly connecting and disconnecting contact 22A of the certain contact switch 22 electrically to contact 22B of the certain contact switch 22 stably.

A pressure causing sheet 21A to sag and causing contact 22A to contact contact 22B to connect contact switch 22 electrically is smaller than a pressure applied to push button 18A for activating push switch 18.

Membrane switch 21 has through-holes 21D above light-emitting elements 19, respectively. Contact switches 22 are coupled to the circuit patterns on circuit board 17 via wiring 23A and connector 23. Circuit board 17 is fixed to the lower surface of case 11 with screws 24, thus providing switch device 25.

Figure 3:
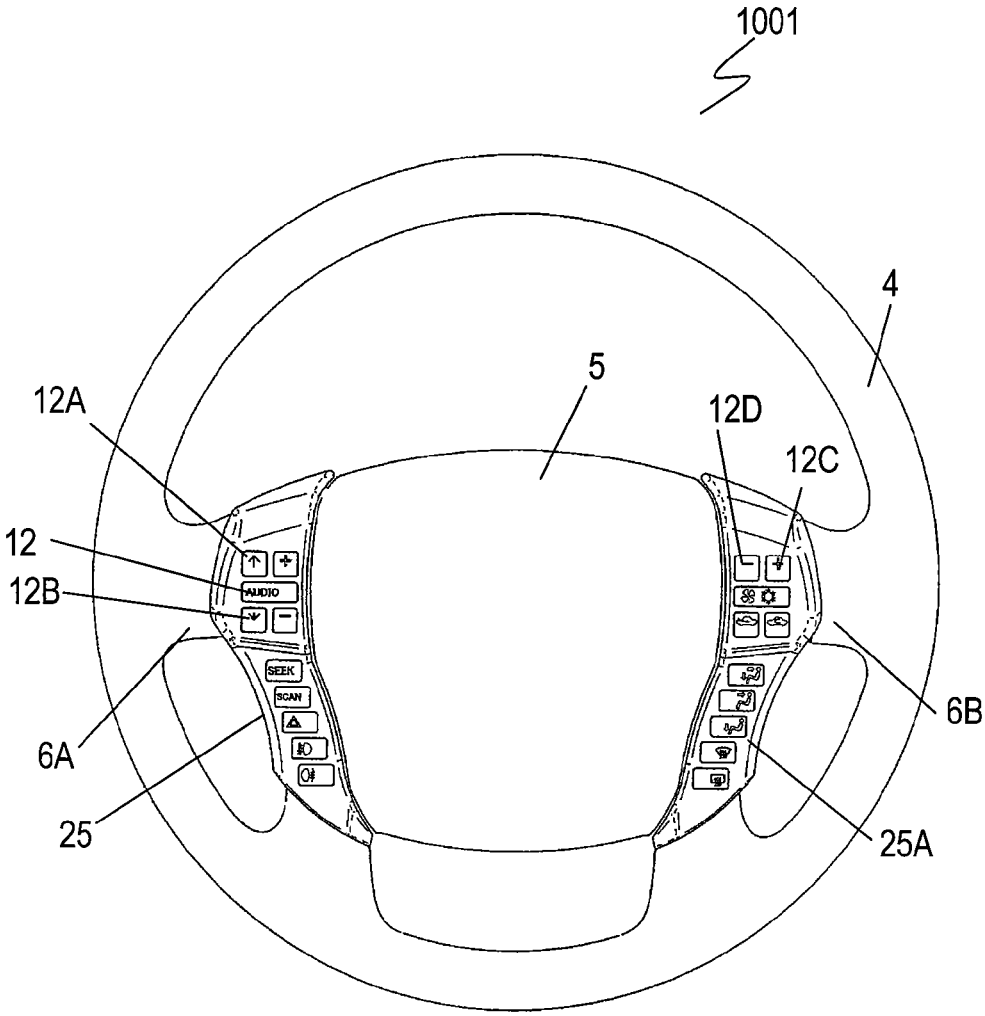
FIG. 3 is a plan view of an input device in accordance with the embodiment.

FIG. 3 is a plan view of input device 1001 in accordance with this embodiment. Input device 1001 includes steering wheel 4, pad 5 provided at the center of steering wheel 4 and containing an airbag, and spokes 6A and 6B provided between steering wheel 4 and pad 5. Switch device 25 is mounted to spoke 6A near steering wheel 4. Switch device 25A, similarly to switch device 25, is mounted to spoke 6B near steering wheel 4. Operation bodies 12A to 12D protrude from the top surfaces pf switch devices 25 and 25A.

Figure 4A:
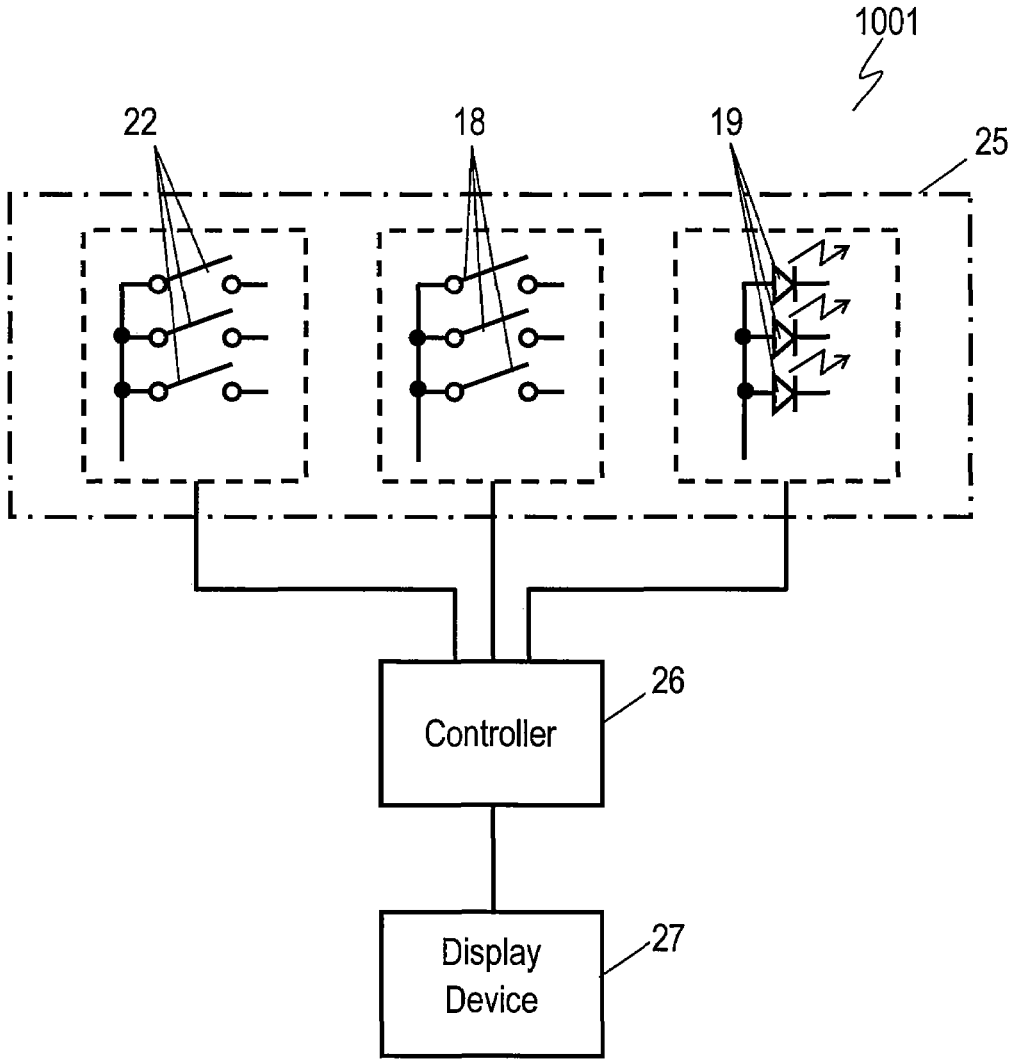
FIG. 4A is a block diagram of the input device in accordance with the embodiment.
Figure 4B:
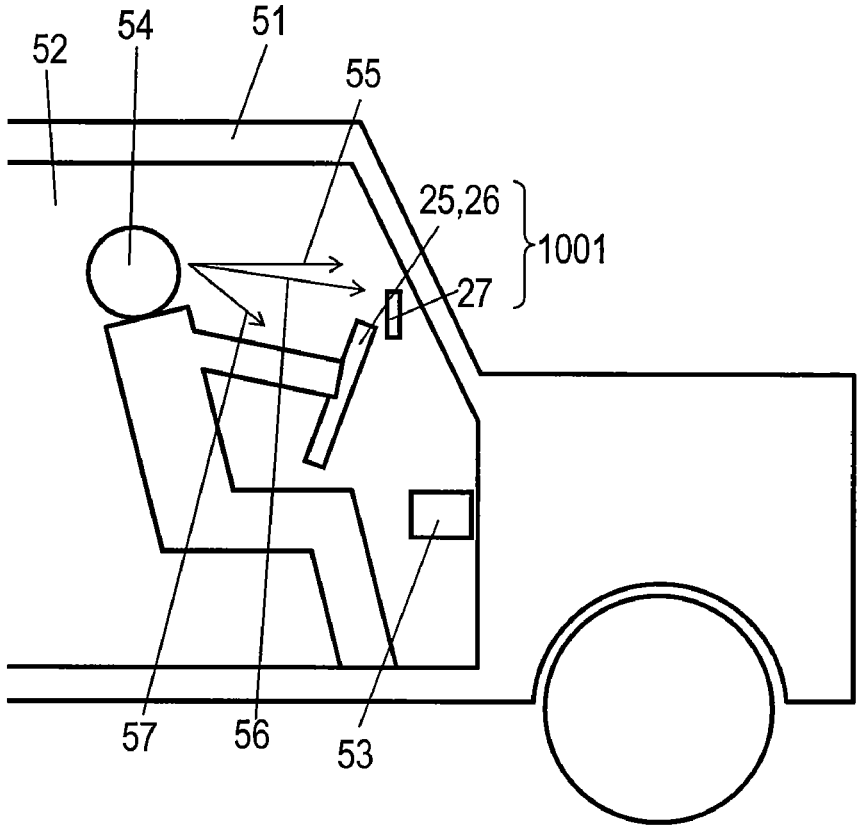
FIG. 4B is a schematic view of a vehicle having the input device mounted thereto in accordance with the embodiment.

FIG. 4A is a circuit block diagram of input device 1001. FIG. 4B is a schematic view of vehicle 51 having input device 1001 mounted thereto. Plural push-switches 18 of switch devices 25 and 25A, contact switches 22 of membrane switch 21, and light emitting elements 19 are coupled to controller 26 including electronic components, such as a microprocessor, via the circuit patterns of circuit board 17. Controller 26 is connected to display section 27 provided in room 52 of vehicle 51 in direction 56 which operator 54 can look at by turning his or her eyes a little away from forward direction 55 during driving. Input device 1001 is installed in direction 57 different from directions 55 and 56. Direction 56 is closer to forward direction 55 than to direction 57.

Upon operator 54 pushing operation body 12A or 12B, contact switch 22 of membrane switch 21 is electrically connected, and push switch 18 is activated. In response to the electrical connection of contact switch 22 and the activation of push switch 18, controller 26 controls, e.g. the audio apparatus or the air-conditioner.

An operation of input device 1001 will be described below. According to this embodiment, operation bodies 12A and 12B of switch device 25 are marked with symbols "↑" and "↓", respectively, on their top surfaces. Push switch 18 provided under operation body 12A is activated, and causes controller 26 to increase a sound volume of the audio apparatus installed in the vehicle. Push switch 18 provided under operation body 12B is activated, and causes controller 26 to decrease the sound volume of the audio apparatus.

Operator 54 has a thumb extend to push operation body 12A with a small pressure while operator 54 holding steering wheel 4. Then, projection 13A moves downward as to push sheet 21A, causes sheet 21A to sag, and causes contact 22A to contact contact 22B on sheet 21B, thus electrically connecting contact switch 22 of membrane switch 21. The pressure necessary for causing sheet 21A to sag to allow contact 22A to contact contact 22B is smaller than the pressure applied to push button 18A to activate push switch 18. Hence, upon operation body 12A being pushed, contact switch 22 of membrane switch 21 is first connected electrically, and then push switch 18 is activated. Then, upon the operator releasing the finger from operation body 12A, push switch 18 is first deactivated, and then, contact switch 22 of membrane switch 21 is electrically disconnected.

Controller 26 detects the electrical connection of contact switch 22, and displays an indication, such as "AUDIO VOLUME UP", for indicating a function of operation body 12A. If the function indicated by the indication matches with what operator 54 intends to do, operator 54 further pushes operation body 12A with the thumb placed on operation body 12A with a pressure larger than the previous, small pressure. Then, projection 13A presses pushing unit 20 to move downward, accordingly causing pushing section 20B to presses push button 18A to activate push switch 18.

Sheets 21A and 21B have slits 21E and holes 21F formed therein between contact switches 22 adjacent to each other, so that sheets 21A and 21B around pressed contact switch 22 sag downward locally without being affected by adjacent contact switch 22 or other portions of sheets 21A and 21B. Sheets 21A and 21B sagging locally press pushing unit 20 to press push button 18A reliably, accordingly activating push switch 18 reliably. In response to the work of push-switch 18, controller 26 controls electronic apparatus 53, such as the audio apparatus, to increase the sound volume.

Operator 54 has a thumb extend to push operation body 12B with a small pressure while holding steering wheel 4. Then, projection 13A provided on the lower surface of operation body 12B pushes sheet 21A to move and sag downward, and causes contact 22A to contact contact 22B on sheet 21B, thus electrically connecting contact switch 22 of membrane switch 21.

Controller 26 detects the electrical connection of contact switch 22, and displays an indication, such as "AUDIO VOLUME DOWN" indicating a function of operation body 12B. If the function indicated by the indication matches with what operator 54 intends to do, operator 54 further pushes operation body 12B with the thumb contacting operation body 12B with a pressure larger than the previous, small pressure. Then, projection 13A presses pushing unit 20 to move downward, so that pushing section 20B presses push button 18A for activating push switch 18. In response to the activation of push-switch 18, controller 26 controls the audio apparatus to decrease the sound volume.

Similarly, operator 54 pushes operation bodies 12C and 12D marked with the symbol "+" and the symbol "–" of switch device 25A as to electrically connect contact switch 22 of membrane switch 21, respectively, and controller 26 accordingly displays on display section 27 indications, such as "AIR-CONDITIONER TEMPERATURE UP" and "AIR-CONDITIONER TEMPERATURE DOWN", indicating respective functions of operation bodies 12C and 12D. Operator 54 further pushes operation bodies 12C and 12D to activate push switches 18 situated under these operation bodies, so that controller 26 controls the air conditioner installed in the vehicle for increase and decrease a set temperature, thereby adjusting the inside temperature.

If operator 54 pushes operation body 12B by mistake in order to increase the sound volume of the audio apparatus, the pushing of operation body 12B connects contact switch 22 electrically, so that controller 26 displays on display section 27 the indication "AUDIO VOLUME DOWN" indicating the function of operation body 12B. Operator 54 looks at display section 27 even when driving the vehicle by turning eyes a little away from forward direction 55, so that operator 54 can recognize that he/she has erroneously pushed operation body 12B which is different from the operation body he/she has intended to push.

In other words, when operator 54 pushes operation body 12 with a finger with a small pressure, contact switch 22 of membrane switch 21 situated between operation body 12 and push switch 18 is electrically connected, so that an indication indicating a function of operation body 12 is displayed on display section 27. Thus, every time pushing the operation body, operator 54 can check the function of operation body 12 before the function is performed. Operator 54 can thus check the function corresponding to operation body 12 being pushed by looking at display section 27 mounted in interior 52 and along forward direction 55 with eyes kept in direction 56 close to forward direction 55, while operator 54 does not necessarily look at display area 16 on top surface 212 of operation body 12. This allows operator 54 to operate the electronic apparatuses easily without operating errors while operator 54 drives the vehicle.

In dark environment, such as the night, operator 54 activates a predetermined switch to cause light emitting element 19 to emit light. This light is transmitted through pushing unit 20, through-hole 21D of membrane switch 21, and light-transmissible section 13 of operation body 12 for illuminating display area 16. Operator 54 can recognize the places of operation bodies 12, 12A, and 12B even in the dark environment.

If operator 54 pushes any one of operation bodies 12, 12A, and 12B with a small pressure, controller 26 detects the electrical connection of contact switch 22 of membrane switch 21 and may cause light emitting element 19 of the pushed operation body out of the operation bodies to emit light for illuminating the display area of the pushed operation body. This operation allows operator 54 to check the function of the pushed operation body more easily in addition to checking the indication displayed on display section 27.

As discussed above, switch device 25 in accordance with this embodiment includes plural operation bodies 12, plural push switches 18 activated by operating bodies 12, and membrane switch 21 having plural contact switches 22 which are placed between plural operation bodies 12 and plural push switches 18. When contact switch 22 is electrically connected, controller 26 displays, on display section 27, an indication indicating a function of operation body 12. Operator 54 pushes operation body 12 with a small pressure so as to electrically connect contact switch 22 of membrane switch 21 corresponding to push switches 18, respectively. Operator 54 can check the function of operation body 12 which has been pushed by checking the indication displayed on display section 27. Thus, switch device 25 and input device 1001 including switch device 25 can be used easily without operating errors.

Sheets 21A and 21B of membrane switch 21 have slits 21E and holes 21F around contact switch 22 (contact 22A and 22B). This structure prevents contact switch 22 adjacent to the contact switch 22 which is pushed from affecting the pushed contact switch 22. The pushed contact switch 22 is thus electrically connected, and push switch 18 corresponding to the contact switch 22 is activated without fail.

Figure 5:
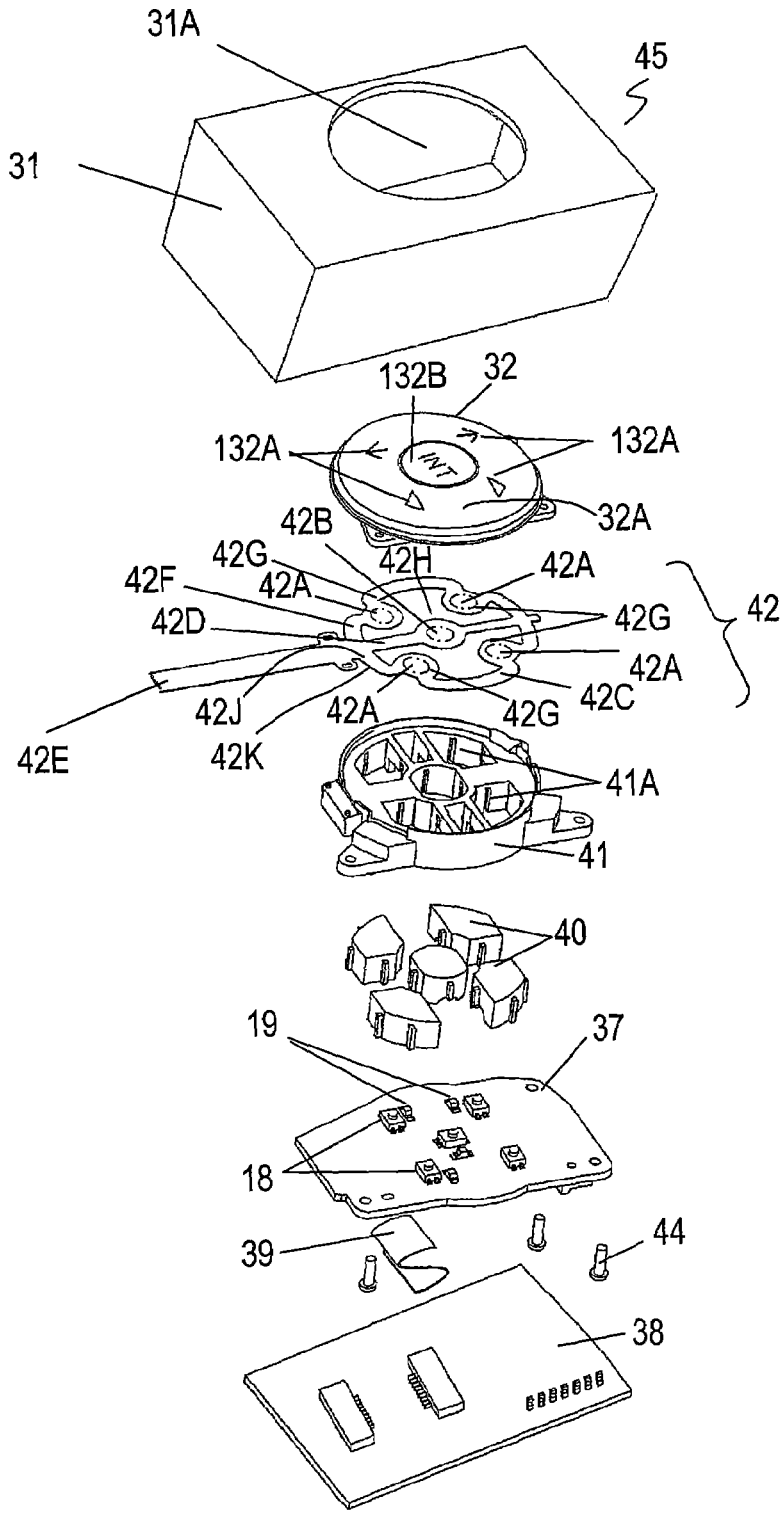
FIG. 5 is a perspective exploded view of another switch device in accordance with the embodiment.
Figure 6:
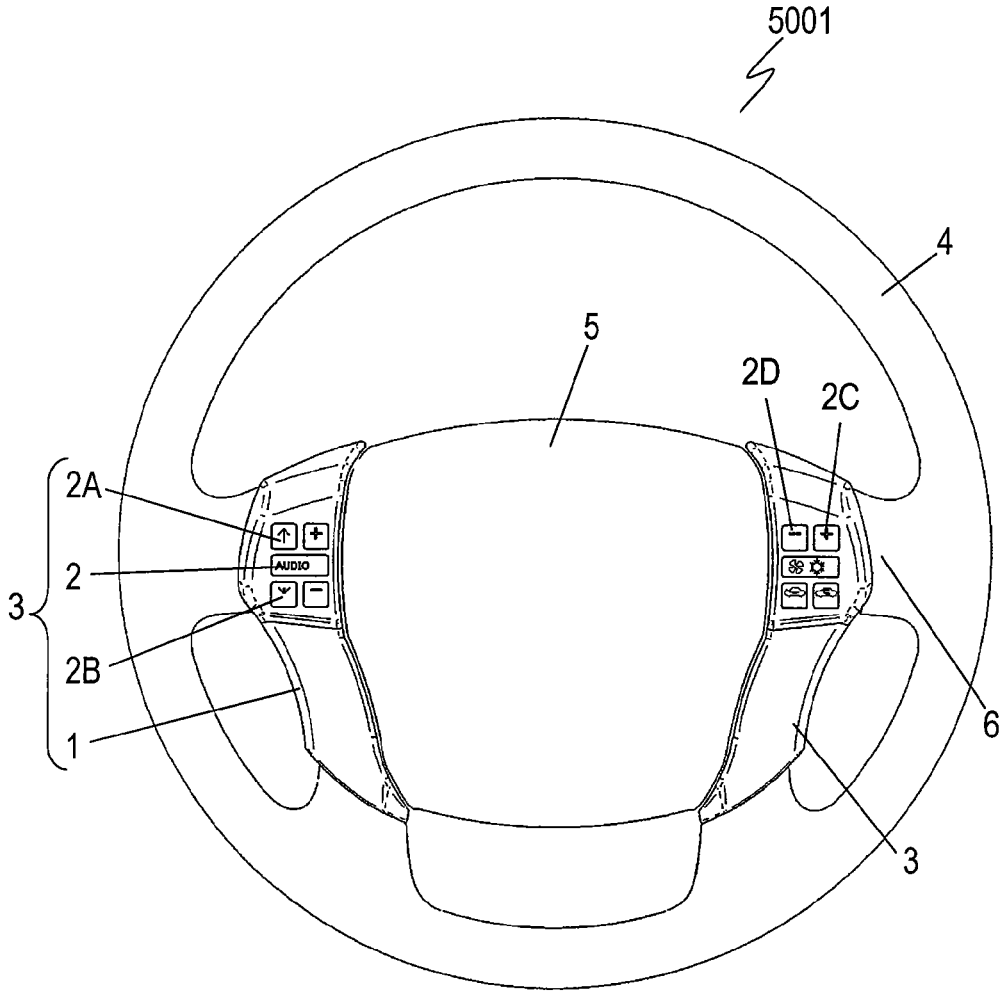
Fig. 6 PRIOR ART
FIG. 6 is a plan view of a conventional input device.

FIG. 5 is a perspective exploded view of another switch device 45. The same components as those of switch device 25 shown in FIGS. 2 and 4A are denoted by the same reference numerals, and their description is omitted. Switch device 45 includes single operation body 32 having a disk shape instead of plural operation bodies 12, 12A, and 12B of switch device 25 shown in FIG. 2.

Top surface 32A of operation body 32 protrudes from opening 31A of case 31. Display area 132B is provided at the center of top surface 32A of the disk shape, and has light-transmissible letters "INT" formed thereon. Plural display areas 132A are provided along a circle having its center identical to the center of top surface 32A. Display areas 132A are marked with symbol "▲", symbol "▼", symbol "↑", and symbol "↓", respectively. One of display areas 132A and 132B is pushed and deforms locally without affecting the other display areas. Cylindrical holder 41 accommodates pushing units 40 inserted movably through guide holes provided in holder 41. Membrane switch 42 is placed between pushing units 40 and operation body 32.

Membrane switch 42, similarly to membrane switch 21 shown in FIG. 1, includes sheets 42J and 42K made of flexible resin having an insulating property, and contact switches 42A and 42B to be connected electrically according to the pressing of display areas 132A and 132B of operation body 32, respectively. Each of contact switches 42A and 42B includes contacts which are provided on sheets 42J and 42K, respectively, and which face each other by a predetermined gap between the contacts. Sheets 42J and 42K include portions 42G where contact switches 42A are provided, respectively. Portions 42G are coupled to each other with bridge bar 42C, thus providing ring portion 42F having a ring shape. Contact switch 42B is coupled to ring portion 42F with bridge bar 42D.

Bridge bars 42C and 42D of sheets 42J and 42K have widths narrower than the widths of sections 42G and 42H where contact switches 42A and 42B are provided. Contact switches 42A protrude inside or outside bridge bar 42C having the ring shape. This structure allows contact switches 42A and 42B to be electrically connected and disconnected independently without affecting each other. Thus, only the contact switch corresponding to the display area which has been pressed is electrically connected (disconnected) reliably.

Push switches 18 and light emitting elements 19 contact the lower surface of pushing unit 40. Push switches 18 and light emitting elements 19 are mounted onto circuit board 37 which is connected to circuit board 38 via flexible connecting board 39. Membrane switch 42 is coupled to circuit board 38 via connector 42E. Circuit board 37, holder 41, and operation body 32 are fixed to case 31 with screws 44. Circuit board 38 is mounted to the lower surface of case 31, thus providing switch device 45.

The pressure necessary for electrically connecting contact switches 42A and 42B of membrane switch 42 is smaller than the pressure necessary for activating push switches 18. When operator 54 pushes one of display areas 132A and 132B of operation body 32, the contact switch of membrane switch 42 under the pushed display area is electrically connected, so that controller 26 displays on display section 27 an indication indicating a function corresponding to the pushed display area. Then, this display area is further pushed with a pressure larger than the previous, small pressure so as to activate push switch 18 under membrane switch 42. Controller 26, similarly to input device 1001 shown in FIG. 2, controls electronic apparatus 53 to execute the function indicated by the indication displayed on display section 27.

In the foregoing discussion, push switch 18 is used for operating electronic apparatus 53 installed in vehicle 51. The switch device in accordance with this embodiment may include, instead of push-switch 18, a switch including a fixed contact provided on circuit board 17 or 37 and a domed movable contact situated above the fixed contact. This switch device may include, instead of push-switch 18, a switch including a fixed contact provided on circuit board 17 or 37, a movable contact provided above the fixed contact, and a domed flexible rubber contact having the movable contact on its lower surface. Thus, switch device 25 and 45 in accordance with this embodiment may include various types of push switches activated by being pushed.

Membrane switches 21 and 42 of switch device 25 and 45 have through-holes 21D through which the light emitted by light emitting element 19 is transmitted. Pushing unit 20 and 40 are light-transmissible. Pushing units 20 and 40 may have light-transmissible through-holes. Membrane switches 21 and 41 may be made of light-transmissible material.

The switch device and the input device including the switch device in accordance with this embodiment can be operated easily without operating errors, and are useful for controlling various electronic apparatuses installed in vehicles.

What is claimed is:

1. A switch device comprising:

an operation body;

a membrane switch including a plurality of contact switches electrically connected upon being pushed by the operation body; and a plurality of push switches activated by pushing the operation body via the membrane switch, respective ones of the plurality of push switches being activated together with respective ones of the plurality of contact switches.

2. The switch device of claim 1, wherein the membrane switch includes a first sheet having an insulating property and sagging by pushing the operation body, and a second sheet having insulating property and sagging by pushing the operation body, and the contact switches of the membrane switch respectively include a plurality of first contacts provided on the first sheet, a plurality of second contacts provided on the second sheet, the plurality of second contacts facing the plurality of first contacts, respectively.

3. The switch device of claim 2, wherein the first sheet has a hole therein between the plurality of first contacts, and the second sheet has a hole therein between the plurality of second contacts.

4. The switch device of claim 2, wherein the first sheet has a slit therein between the plurality of first contacts, and the second sheet has a slit therein between the plurality of second contacts.

5. The switch device of claim 2, wherein the first sheet includes a plurality of portions provided around the first contacts, respectively, and a bridge bar provided between the plurality of portions of the first sheet, and the second sheet includes a plurality of portions provided around the second contacts, respectively; and a bridge bar provided between the plurality of portions of the second sheet.

6. The switch device of claim 1, further comprising a case having a opening through which the operation body protrude.

7. The switch device of claim 1, wherein a pressure for electrically connecting the plurality of contact switches of the membrane switch is smaller than a pressure for activating the plurality of push switches.

8. The switch device of claim 1, wherein the operation body comprises a plurality of operation bodies operable to push plurality of contact switches of the membrane switch to electrically connect the plurality of contact switches, respectively, and operable to push the plurality of push switches via the membrane switch to activate the plurality of the push switches, respectively.

9. An input device adapted to operate an electronic apparatus, said input device comprising:

a plurality of operation bodies;

a membrane switch including a plurality of contact switches electrically connected upon being pushed by the operation bodies, respectively;

a plurality of push switches activated by pushing the operation bodies via the membrane switch, respective ones of the plurality of push switches being activated together with respective ones of the plurality of contact switches;

a display section; and a controller operable to control the electronic apparatus in response to activation of the plurality of push-switches, and display, on the display section, indications in response to electrical connection of the plurality of contact switches of the membrane switch.

10. The input device of claim 9, further comprising a steering wheel having the plurality of operation bodies, the membrane switch, and the plurality of push switches mounted thereto.

11. The input device of claim 9, wherein the operation body comprises a plurality of operation bodies operable to push plurality of contact switches of the membrane switch to electrically connect the plurality of contact switches, respectively, and operable to push the plurality of push switches via the membrane switch to activate the plurality of the push switches, respectively.

12. The input device of claim 9, wherein the controller is operable to display, on the display section, indications different from each other in response to electrical connection of the plurality of contact switches of the membrane switch, respectively.

13. A switch device comprising:

an operation body;

a membrane switch including a plurality of contact switches electrically connected upon being pushed by the operation body; and a plurality of push switches activated by pushing the operation body via the membrane switch, wherein the membrane switch includes:

a first sheet having an insulating property and sagging by pushing the operation body, and a second sheet having insulating property and sagging by pushing the operation body, the contact switches of the membrane switch respectively include:

a plurality of first contacts provided on the first sheet, a plurality of second contacts provided on the second sheet, the plurality of second contacts facing the plurality of first contacts, respectively, and the first sheet has a hole therein between the plurality of first contacts, and the second sheet has a hole therein between the plurality of second contacts.

14. The switch device of claim 13, further comprising a case having a opening through which the operation body protrude.

15. The switch device of claim 13, wherein a pressure for electrically connecting the plurality of contact switches of the membrane switch is smaller than a pressure for activating the plurality of push switches.

16. The switch device of claim 13, wherein the operation body comprises a plurality of operation bodies operable to push plurality of contact switches of the membrane switch to electrically connect the plurality of contact switches, respectively, and operable to push the plurality of push switches via the membrane switch to activate the plurality of the push switches, respectively.

17. A switch device comprising:

an operation body;

a membrane switch including a plurality of contact switches electrically connected upon being pushed by the operation body; and a plurality of push switches activated by pushing the operation body via the membrane switch, wherein the membrane switch includes:

a first sheet having an insulating property and sagging by pushing the operation body, and a second sheet having insulating property and sagging by pushing the operation body, the contact switches of the membrane switch respectively include:

a plurality of first contacts provided on the first sheet, a plurality of second contacts provided on the second sheet, the plurality of second contacts facing the plurality of first contacts, respectively, and the first sheet has a slit therein between the plurality of first contacts, and the second sheet has a slit therein between the plurality of second contacts.

18. The switch device of claim 17, further comprising a case having a opening through which the operation body protrude.

19. The switch device of claim 17, wherein a pressure for electrically connecting the plurality of contact switches of the membrane switch is smaller than a pressure for activating the plurality of push switches.

20. The switch device of claim 17, wherein the operation body comprises a plurality of operation bodies operable to push the plurality of contact switches of the membrane switch to electrically connect the plurality of contact switches, respectively, and operable to push the plurality of push switches via the membrane switch to activate the plurality of the push switches, respectively.

21. A switch device comprising:

an operation body;

a membrane switch including a plurality of contact switches electrically connected upon being pushed by the operation body; and a plurality of push switches activated by pushing the operation body via the membrane switch, wherein the membrane switch includes:

a first sheet having an insulating property and sagging by pushing the operation body, and a second sheet having insulating property and sagging by pushing the operation body, the contact switches of the membrane switch respectively include:

a plurality of first contacts provided on the first sheet, a plurality of second contacts provided on the second sheet, the plurality of second contacts facing the plurality of first contacts, respectively, the first sheet includes:

a plurality of portions provided around the first contacts, respectively, and a bridge bar provided between the plurality of portions of the first sheet, and the second sheet includes:

a plurality of portions provided around the second contacts, respectively; and a bridge bar provided between the plurality of portions of the second sheet.

22. The switch device of claim 21, further comprising a case having a opening through which the operation body protrude.

23. The switch device of claim 21, wherein a pressure for electrically connecting the plurality of contact switches of the membrane switch is smaller than a pressure for activating the plurality of push switches.

24. The switch device of claim 21, wherein the operation body comprises a plurality of operation bodies operable to push plurality of contact switches of the membrane switch to electrically connect the plurality of contact switches, respectively, and operable to push the plurality of push switches via the membrane switch to activate the plurality of the push switches, respectively.

25. An input device adapted to operate an electronic apparatus, said input device comprising:

a plurality of operation bodies;

a membrane switch including a plurality of contact switches electrically connected upon being pushed by the operation bodies, respectively;

a plurality of push switches activated by pushing the operation bodies via the membrane switch, respectively;

a display section; and a controller operable to:

control the electronic apparatus in response to activation of the plurality of push-switches, and display, on the display section, indications in response to electrical connection of the plurality of contact switches of the membrane switch, wherein the membrane switch includes:

a first sheet having an insulating property and sagging by pushing the operation body, and a second sheet having insulating property and sagging by pushing the operation body, the contact switches of the membrane switch respectively include:

a plurality of first contacts provided on the first sheet, a plurality of second contacts provided on the second sheet, the plurality of second contacts facing the plurality of first contacts, respectively, and the first sheet has a hole therein between the plurality of first contacts, and the second sheet has a hole therein between the plurality of second contacts.

26. The input device of claim 25, wherein the operation body comprises a plurality of operation bodies operable to push plurality of contact switches of the membrane switch to electrically connect the plurality of contact switches, respectively, and operable to push the plurality of push switches via the membrane switch to activate the plurality of the push switches, respectively.

27. An input device adapted to operate an electronic apparatus, said input device comprising:

a plurality of operation bodies;

a membrane switch including a plurality of contact switches electrically connected upon being pushed by the operation bodies, respectively;

a plurality of push switches activated by pushing the operation bodies via the membrane switch, respectively;

a display section; and a controller operable to:

control the electronic apparatus in response to activation of the plurality of push-switches, and display, on the display section, indications in response to electrical connection of the plurality of contact switches of the membrane switch, wherein the membrane switch includes:

a first sheet having an insulating property and sagging by pushing the operation body, and a second sheet having an insulating property and sagging by pushing the operation body, the contact switches of the membrane switch respectively include:

a plurality of first contacts provided on the first sheet, a plurality of second contacts provided on the second sheet, the plurality of second contacts facing the plurality of first contacts, respectively, and the first sheet has a slit therein between the plurality of first contacts, and the second sheet has a slit therein between the plurality of second contacts.

28. The input device of claim 27, wherein the operation body comprises a plurality of operation bodies operable to push plurality of contact switches of the membrane switch to electrically connect the plurality of contact switches, respectively, and operable to push the plurality of push switches via the membrane switch to activate the plurality of the push switches, respectively.

29. An input device adapted to operate an electronic apparatus, said input device comprising:

a plurality of operation bodies;

a membrane switch including a plurality of contact switches electrically connected upon being pushed by the operation bodies, respectively;

a plurality of push switches activated by pushing the operation bodies via the membrane switch, respectively;

a display section; and a controller operable to:

control the electronic apparatus in response to activation of the plurality of push-switches, and display, on the display section, indications in response to electrical connection of the plurality of contact switches of the membrane switch, wherein the membrane switch includes:

a first sheet having an insulating property and sagging by pushing the operation body, and a second sheet having insulating property and sagging by pushing the operation body, the contact switches of the membrane switch respectively include:

a plurality of first contacts provided on the first sheet, a plurality of second contacts provided on the second sheet, the plurality of second contacts facing the plurality of first contacts, respectively, the first sheet includes:

a plurality of portions provided around the first contacts, respectively, and a bridge bar provided between the plurality of portions of the first sheet, and the second sheet includes:

a plurality of portions provided around the second contacts, respectively; and a bridge bar provided between the plurality of portions of the second sheet.

30. The input device of claim 29, wherein the operation body comprises a plurality of operation bodies operable to push plurality of contact switches of the membrane switch to electrically connect the plurality of contact switches, respectively, and operable to push the plurality of push switches via the membrane switch to activate the plurality of the push switches, respectively.

* * * * *